United States Patent [19]

Scheurecker

[11] 4,222,432

[45] Sep. 16, 1980

[54] ARRANGEMENT FOR SEPARATING THE STARTER BAR FROM THE HOT STRAND IN THE STRAND GUIDEWAY OF A CONTINUOUS CASTING PLANT

[75] Inventor: Werner Scheurecker, Linz, Austria

[73] Assignee: Voest-Alpine Aktiengesellschaft, Linz, Austria

[21] Appl. No.: 59,067

[22] Filed: Jul. 19, 1979

[30] Foreign Application Priority Data

Aug. 4, 1978 [AT] Austria ..... 5670/78

[51] Int. Cl.[3] ..... B22D 11/08

[52] U.S. Cl. ..... 164/446; 164/263

[58] Field of Search ..... 164/263, 425, 426, 445, 164/446

[56] References Cited

U.S. PATENT DOCUMENTS

| | | | |
|---|---|---|---|
| 3,266,104 | 8/1966 | Foldessy et al. | 164/446 |
| 3,274,653 | 9/1966 | Foldessy et al. | 164/426 |
| 3,971,429 | 7/1976 | Horeth | 164/446 X |
| 4,121,652 | 10/1978 | Loibl | 164/446 |

FOREIGN PATENT DOCUMENTS

| | | | |
|---|---|---|---|
| 1583605 | 10/1970 | Fed. Rep. of Germany | 164/446 |
| 1399575 | 7/1975 | United Kingdom | 164/426 |

*Primary Examiner*—Robert D. Baldwin

*Attorney, Agent, or Firm*—Brumbaugh, Graves, Donohue & Donohue

[57] ABSTRACT

An arrangement for separating a starter bar from a hot strand in a continuous casting plant employs a starter bar head that that is tong-shaped and includes a latch movable between between a position in which the cheeks of the tong are locked and a released position. A switch member is movable into and out of a recess of the starter bar head for driving the latch from its locked position to its released position. The latch includes a projection which cooperates with a counter stop on the strand guideway to reclose the latch once the separation has occurred. the separation has occurred.

8 Claims, 4 Drawing Figures

ARRANGEMENT FOR SEPARATING THE STARTER BAR FROM THE HOT STRAND IN THE STRAND GUIDEWAY OF A CONTINUOUS CASTING PLANTBACKGROUND OF THE INVENTION

The invention relates to an arrangement for separating the starter bar from the hot strand in the strand guideway of a continuous casting plant, wherein the starter bar head is designed like a pair of tongs and the two tong cheeks are lockable in the tong closing position and releasable from each other by an opening mechanism.

The connection of a tong-shaped starter bar head with the hot strand can be realized with the help of a rail-shaped connecting piece cast in the strand end or with tong bits cast out of the strand itself. For separating the hot strand from the starter bar, various arrangements are known. U.S. Pat. No. 3,971,429 for instance shows an arrangement of the initially-described kind, wherein the forced opening of the tong cheeks is effected by means of guide rails in which extensions coacting with the tong cheeks engage. The tong cheeks are opened when the starter bar head passes the guide rails. These guide rails are arranged laterally outside the region of the greatest slab width, thus requiring long extensions at the tongs which may come into conflict with the guide arrangements laterally supporting the strand. The guide rails are continuously subjected to the radiation heat of the strand. With this arrangement, destruction of the guide rails due to the extraction forces at the starter bar may occur, for instance if the tong bits are welded together with the hot strand on account of an insufficient sealing.

It is furthermore known from U.S. Pat. No. 4,121,652 to first cut off the crop end from the hot strand with a torch-cutting machine and to detach the crop end from the starter bar beyond the torch-cutting roller table after the starter bar has been brought into a vertical position. As an opening mechanism, a mandrel is provided by which the locking means of the tong cheeks, comprising a bayonet catch, is releasable. By lifting the starter bar and placing it into a vertical position, a special supporting construction is necessary. The starter bar has to be held still and to be centered during the release of the tong cheeks. Lifting of the crop end, which at first is still anchored in the starter bar head, requires an increased expenditure of work. SUMMARY OF THE INVENTION The invention aims at avoiding these disadvantages and difficulties and has as its object to provide an operationally safe separating arrangement in which opening of the tong cheeks prior to cutting off of the crop end is simplified and facilitated, and in which separation of the starter bar from the hot strand is possible during the extraction movement of the starter bar, i.e. without requiring the starter bar to stand still.

These objects are achieved with an arrangement of the initially-defined kind by the combination of the following characteristic features:

a latch is pivotably mounted on a first tong cheek, which latch is movable from a holding position, in which it overlaps with its hook end an extension of the second tong cheek and holds the tong cheeks in the closed position, into a release position releasing the extension of the second tong cheek;

a bolt displaceable in the axial direction of the starter bar is mounted in the second tong cheek, which bolt with its head end contacts the hook end of the latch, and with its other end, i.e. foot end, extends towards the foot part of the starter bar and projects into a recess of the starter bar head which is open towards a side face of the second tong cheek;

a switch member is stationarily mounted on the strand guideway, which switch is movable into the recess of the starter bar head by means of an adjustment device, can be brought into contact with the foot end of the bolt and is retractable from the recess;

the latch is provided with a projection directed to a side face of the first tong cheek, which projection comes to lie within a recess of the first tong cheek when the latch is in the holding position, and is in a position in which it projects beyond the side face of the first tong cheek when the latch is in the release position; and a counter stop coacting with the projection of the latch is provided at the strand guideway, the latch being movable into the holding position by pivoting the projection back into the recess.

Advantageously, a guiding roller of the strand guideway is provided as a counter stop moving the projection of the latch.

According to an advantageous embodiment, the latch comprises a further arm extending approximately in the longitudinal direction of the starter bar with the latch in the holding position, which arm contacts the second tong cheek when pivoting the latch so as to open the tong cheeks, and forcibly moves the tong cheeks into the opening direction.

Suitably, the switch member is provided at the beginning of the torch-cutting roller table, whereby it is possible to effect a separation of the hot strand from the starter bar by means of a separation cut if the tong cheeks of the starter bar head are welded together with the hot strand, so that an interruption of casting is not necessary.

The switch member advantageously comprises an end part that is displaceable in the moving direction of the switch member, which end part is pressed in the direction to the strand guideway by a spring force. The end part thus always assumes the exact position when releasing the tong cheeks.

In order to assure that the end part of the switch member automatically reaches a retracted position when the tong cheeks are moved past it, the recess of the second tong cheek is delimited in the longitudinal direction of the strand by end faces enclosing an acute angle with the moving direction of the switch member, the acute angle being larger than the friction angle pertaining to the friction between the end faces of the recess and the end part of the switch member.

In order to prevent damage to the end part of the switch member when the bolt cannot be moved for any reason whatsoever, the end face at the foot end of the bolt encloses an acute angle with the moving direction of the switch member, which angle is larger than the friction angle pertaining to the friction between the end part of the switch member and the end face of the bolt.

In order to prevent unintentional opening of the tong cheeks prior to reaching the switch member, a locking pin is hinged to the arm of the latch and penetrates through the second tong cheek into a recess of the bolt, and the recess in the bolt comprises a step contacting the locking pin at its front face when the latch is in the holding position. BRIEF DESCRIPTION OF THE DRAWINGS The invention will now be explained in more detail by way of one embodiment illustrated in the accompanying drawings, wherein.

Figure 1:
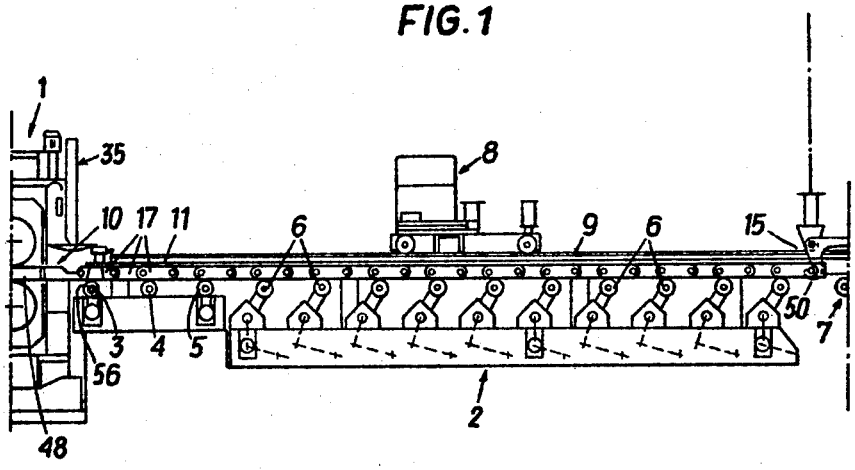
FIG. 1 shows the torch-cutting roller table in the horizontal part of the strand guide of a bow-type continuous casting plant.
Figure 4:
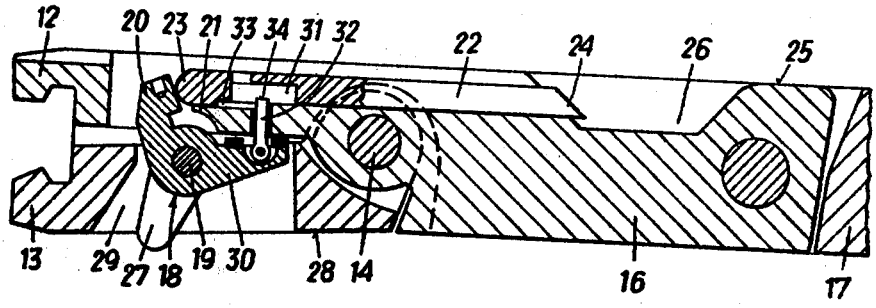
Figure 2:
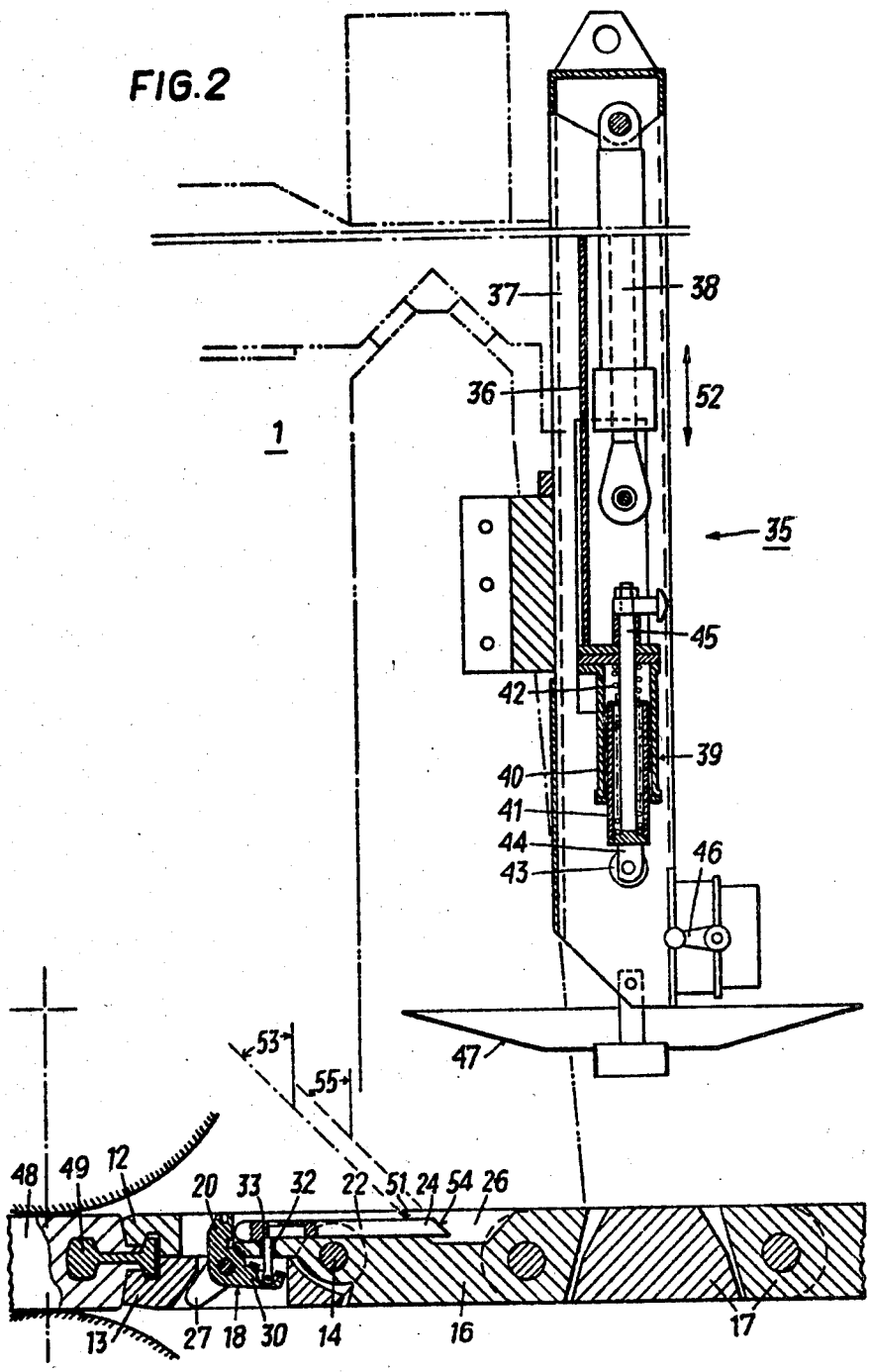
FIG. 2 represents a vertical section of a detail of FIG. 1 along the longitudinal axis of the strand guideway with the tong cheeks of the starter bar head being in the tong closing position.
Figure 3:
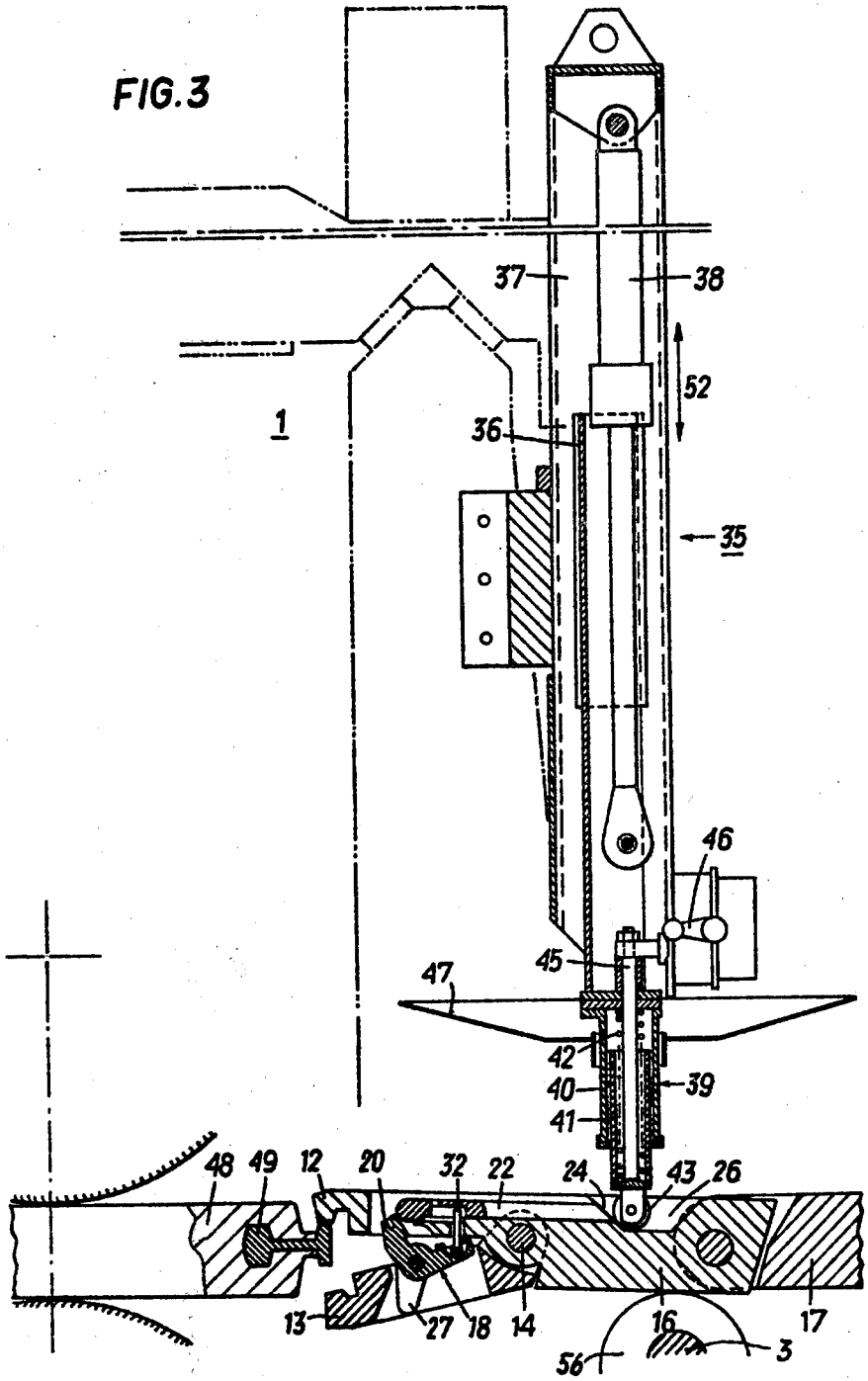

FIG. 3 illustrates in the same representation as FIG. 2, the procedure of opening the tong cheeks, and FIG. 4 is a sectional view of the tong-shaped starter bar head on an enlarged scale. DESCRIPTION OF AN ILLUSTRATIVE EMBODIMENT In FIG. 1, a driving roll stand 1 is arranged at the end of a bow-shaped strand guideway (not illustrated.) Following thereupon, an approximately horizontally arranged torch-cutting roller table 2 is arranged, whose first three rollers 3, 4, 5 are stationarily arranged and whose further rollers 6 are arranged to be liftable and lowerable. After the torch-cutting roller table, a further roller table 7 follows for conveying the slabs already separated from the hot strand. A torch-cutting car 8 is displaceable on rails 9 above the torch-cutting roller table 2.

The starter bar head 10 of the starter bar 11 is designed as a pair of tongs; the tong cheeks 12, 13 of which are hinged to each other with the lower or first tong cheek 13 being pivotable about a bolt 14 relative to the upper or second tong cheek 12. The upper tong cheek 12 is elongated in the direction toward the foot part 15 of the starter bar 11. To its end 16 a first link body 17 of the starter bar 11, which is formed of link, is hinged. On the first tong cheek 13, a latch 18 is mounted to be pivotable about a bolt 19. This latch has a hook end 20 with which it overlaps an extension 21 of the second tong cheek, when it is in the holding position, as is illustrated in FIG. 2. This hook end 20 thus keeps the tong cheeks 12, 13 in the closing position.

In the second tong cheek 12, a bolt 22 displaceable in the axial direction of the starter bar is inserted, which bolt, with its head end 23, contacts the hook end 20 of the latch 18 and pivots the latch about the bolt 19 into a release position during displacement in the direction towards the hook end 20. In the release position the hook end 20 of the latch releases the extension 21 of the second tong cheek 12. The bolt 22, with its foot end 24, projects into a recess 26 that is open towards a side face 25 of the second tong cheek 12. A projection 27 is firmly connected with the latch 18 or is designed in one piece with the same, which projection is directed to a side face 28 of the first tong cheek. With the latch 18 in the holding position, the projection comes to lie within a recess 29 of the first tong cheek 13 and, with the latch 18 in the release position, it comes to lie in a position beyond this side face 28 of the first tong cheek 13.

Furthermore, the latch 18 comprises an arm 30 situated approximately in the longitudinal direction of the starter bar with the latch in the holding position, which arm comes into contact with the second tong cheek 12 when the latch is pivoted into the release position, thus forcibly moving the tong cheeks 12, 13 away from each other into the opening position (cf. FIGS. 3 and 4). To this arm is hinged a locking pin 32 that penetrates through the second tong cheek 12 into a recess 31 of the bolt 22. The length of the locking pin 32 is measured such that it will extend as far as a step 33 in a recess 31 of the bolt 22, when the latch 18 is in the holding position, and will contact this step with its front face 34 (cf. FIG. 2). As a result, pivoting of the latch 18 without prior displacement of the bolt 22 is not possible, i.e unintentional opening of the tong cheeks 12, 13 is prevented.

A switch member 35 for opening the tong cheeks 12, 13 is mounted at the run-out end of the driving roll stand 1. This member comprises a sledge 36 that is approximately vertically displaceable and guided by a guide rail 37 fastened on the driving roll stand 1, and movable by means of a pressure-medium cylinder 38. The lower end part 39 of the sledge is designed as a sleeve 40 into which a further sleeve 41 is displaceably inserted. The further sleeve is pressed down in the direction toward the roller way 2, relative to the guiding sledge, by means of a helical spring 42. At the lower end of this further sleeve 41, a roller 43 is rotatably fastened by means of lugs 44. In the center of this displaceable sleeve 41, a ram 45 vertically projects into the interior of the guiding sledge 36, which ram serves for actuating a switch 46 mounted on the guide rail and causing the retraction of the guiding sledge. In the retracted position, as can be seen from FIG. 2, the end part 39 comprising the roller 43 comes to lie behind a protection plate 47.

The arrangement functions in the following way:

At first, the starter bar 11 is conveyed into the position illustrated in FIG. 1 and in FIG. 2, respectively, by means of the driving rolls of the driving roll stand. The hot strand 48, in this position of the starter bar, is still firmly connected with the tong cheeks 12, 13, by directly casting out the end of the strand to receive the tong cheeks or by inserting a rail piece 49 into the tong cheeks and casting around this rail piece, as is shown by FIG. 2. The position of the starter bar according to FIG. 1 and FIG. 2, respectively, is indicated via a path tracking system or by means of light gates, whereupon the lowering of the switch member 35 is automatically effected, so that a direct observance of the starter bar, or an operator for the switch member 35, are not required. When lowering the switch member, the resilient end part 39 with its roller 43 will sit on the upper side face 25 of the starter bar 11, automatically snapping into the recess 26 of the second tong cheek 12 with further movement of the starter bar. As long as the tong cheeks are still closed, further horizontal movement of the starter bar takes place by the driving rolls of the driving roll stand 1, which are in engagement with the hot strand 48, pushing the strand against the starter bar. Further movement of the starter bar in the extraction direction causes the roller 43 of the end part 39 to come into contact with the foot end 24 of the bolt 22, thus displacing the bolt 22 relative to the starter bar head opposite to the moving direction of the starter bar. Thereby, the latch is pivoted into the release position illustrated in FIG. 3, the tong cheeks thus opening. As soon as the tong cheeks have opened, a hook 50 (FIG. 1) of a lifting device engages in the foot part 15 of the starter bar 11, whereby the starter bar head 10 of the starter bar 11, if desired with the aid of the drivable rollers 6 of the torch-cutting roller table 2, is moved further in the extraction direction, while the foot part 15 is lifted from the roller table 2. This horizontal movement of the starter bar head takes place at a higher speed than the extraction speed for the hot strand. The roller 43 of the end part 39 automatically slides out of the recess at the front inclined face 51 of the recess 26, since this end face 51 encloses an acute angle 53 (FIG. 2) with the moving direction 52 of the switch member 35, which angle is larger than the friction angle pertaining to the friction between this end face 51 and the end part 39 (roller 43) of the switch member 35. The spring 42 is measured such that its spring force prevents too early a driving back of the end part 39 of the switch member 35, but allows the same to recede from the recess 26 in case there is the risk of damage to the end part. As soon as the roller 43 is forced to the upper side 25 of the second tong cheek 12, the switch 46 is actuated by the ram 45 (cf. FIG. 3), which switch then causes the sledge 36 to be retracted into its starting position, which is illustrated in FIG. 2. If the movement of the bolt 22 is impeded, for instance by damage at the latch 18, the end part 39 of the switch member 35 will slide up the inclined end face 54 of the foot end 24 of the bolt 22, whereupon it is retracted behind the protection plate 47 after actuation of the switch 46 by the ram 45. In order to ensure sliding off of the end part, the end face 54 of the foot end 24 of the bolt 22, encloses an acute angle 55 with the moving direction 52 of the switch member 35, which angle that is larger than the friction angle pertaining to the friction between this end face and the end part of the switch member. Separation of the starter bar from the hot strand in this case may be effected by the torch-cutting means, so that no interruption in casting is required.

As soon as the end part 39 of the switch member 35 has been moved out of the recess 26, the upper, second tong cheek 12 falls back into its starting position due to its own weight, while the lower, first tong cheek 13 at first continues to hang down due to its own weight. It is then driven upwards towards the second tong cheek 12 by the rollers 3, 4, 5 arranged at the lower side of the strand guideway. Movement of the latch 18 into the closing position is effected with the help of the projection 27 of the latch, which, if pushed against the roller denoted by 4, is driven back into the recess 29 of the first tong cheek 13, which recess is open towards the lower side, the latch 18 thus being pivoted into the holding position.

The first roller 3, arranged at the lower side after the driving roll stand, would cause too early a movement of the latch into the holding position, for which reason this roller has a groove 56 about its circumference, so that the projection of the latch cannot come into contact with this roller. The switch 46 of the switch member 35, simultaneously with the retraction movement of the guiding sledge 36, causes a faster conveyance away of the starter bar 11, so that the latter will not be in the way of the hot strand 48 any longer.

What I claim is:

1. In an arrangement for separating a starter bar from a hot strand in a continuous casting plant strand guideway, including a starter bar head designed like a pair of tongs having a first tong cheek and a second tong cheek, said first and said second tong cheeks being lockable in a tong closing position, an opening mechanism being provided for releasing said first tong cheek from said second tong cheek, the improvement which is characterized in that a latch having a hook end is pivotably mounted on said first tong cheek and an extension is provided on said second tong cheek, said latch being movable between a holding position in which it overlaps said extension with its hook end and holds said first and said second tong cheeks in a closing position, and a release position in which it releases said extension of said second tong cheek, a bolt having a head end and a foot end is mounted in said second tong cheek so as to be displaceable in approximately the axial direction of said starter bar, said starter bar having a foot part and said starter bar head including a second tong cheek recess open towards a side face of said second tong cheek, said head end of said bolt contacting said hook end of said latch and said foot end of said bolt projecting into said second tong cheek recess in a direction towards the foot part of said starter bar, a switch member is stationarily mounted at the strand guideway and an adjustment device is provided to move said switch member into said second tong cheek recess of said starter bar head, to bring it into contact with said foot end of said bolt and to retract it out of said recess, a latch projection directed to a side face of said first tong cheek is provided, said first tong cheek including a first tong cheek recess, in said holding position of said latch said latch projection comes to lie within said first tong cheek recess, while in said release position of said latch, said latch projection comes to lie in a position projecting beyond the side face of said first tong cheek, and a counter stop coacting with said latch projection is provided at said strand guideway, said latch being movable into said holding position by the pivoting back of said latch projection into the first tong cheek recess by means of said counter stop.

2. An arrangement as set forth in claim 1, wherein said counter stop pivoting said latch projection is formed by a guiding roller of said strand guideway.

3. An arrangement as set forth in claim 1, wherein said latch includes an arm which, when the latch is in said holding position of said latch, extends approximately in the longitudinal direction of said starter bar, said arm contacting said second tong cheek during pivoting of said latch so as to open said first and said second tong cheeks, and forcibly move said first and said second tong cheeks in the opening direction.

4. An arrangement as set forth in claim 1, wherein said strand guideway includes a torch-cutting roller table, said switch member being provided at the beginning of said torch-cutting roller table.

5. An arrangement as set forth in claim 1, wherein said switch member includes an end part displaceable in the moving direction of said switch member, said end part being pressed in the direction toward said strand guideway by spring force.

6. An arrangement as set forth in claim 5, further comprising end faces delimiting said second tong cheek recess in the longitudinal direction of the strand and enclosing an acute angle with the moving direction of said switch member, said acute angle being larger than the friction angle pertaining to the friction prevailing between said end faces and said end part.

7. An arrangement as set forth in claim 5 or 6, wherein said foot end of said bolt includes a further end face, and said further end face encloses a further acute angle with the moving direction of said switch member, said further acute angle being larger than the friction angle pertaining to the friction prevailing between said end part and said further end face.

8. An arrangement as set forth in claim 3, wherein the bolt mounted in said second tong cheek includes a bolt recess, a locking pin being hinged to said arm of said latch and penetrating through said second tong cheek into said bolt recess, said bolt recess including a step contacting the front face of said locking pin when said latch is in said holding position.

* * * * *